US006361199B1

(12) United States Patent
Jorgenson

(10) Patent No.: US 6,361,199 B1
(45) Date of Patent: Mar. 26, 2002

(54) CEMENT MIXING APPARATUS AND METHOD

(75) Inventor: Ronald Jorgenson, Maple Plain, MN (US)

(73) Assignee: Maxxon Corporation, Hamel, MN (US)

( * ) Notice: Subject to any disclaimer, the term of this patent is extended or adjusted under 35 U.S.C. 154(b) by 0 days.

(21) Appl. No.: 09/537,878

(22) Filed: Mar. 29, 2000

(51) Int. Cl.[7] ..... B28C 7/04
(52) U.S. Cl. ..... 366/8; 366/19; 366/30
(58) Field of Search ..... 366/2, 6, 8, 16, 366/19, 30, 33, 34, 37, 40, 51, 160.4, 167.1, 267

(56) References Cited

U.S. PATENT DOCUMENTS 1,523,548 A * 1/1925 Lichtenberg
2,191,419 A * 2/1940 Bohmer et al.
4,075,374 A * 2/1978 Jorgenson et al.
4,159,912 A * 7/1979 Jorgenson
4,298,288 A * 11/1981 Weisbrod ..... 366/8
4,322,167 A * 3/1982 Hill ..... 366/8
4,436,431 A * 3/1984 Strong et al. ..... 366/17
4,597,802 A 7/1986 Alexanderson et al.
4,614,146 A * 9/1986 Ross et al.
4,652,175 A 3/1987 Mauthe
4,661,159 A 4/1987 Ortega et al.
4,830,505 A * 5/1989 Dunton et al. ..... 366/2
4,934,596 A 6/1990 Hilton et al.
5,137,365 A * 8/1992 Westrich ..... 366/40
5,229,437 A 7/1993 Knight
5,340,612 A 8/1994 Perito
5,382,618 A 1/1995 Castel
5,386,925 A * 2/1995 Lane
5,401,538 A 3/1995 Perito
5,424,099 A 6/1995 Stewart et al.
5,472,500 A 12/1995 Janicki
5,590,976 A * 1/1997 Kilheffer et al. ..... 366/8
5,629,048 A 5/1997 Kinney
5,634,972 A 6/1997 Pacanovsky et al.
5,668,298 A * 9/1997 Musil et al. ..... 366/34
5,685,903 A 11/1997 Stav et al.
5,718,759 A 2/1998 Stav et al.
5,746,822 A 5/1998 Espinoza et al.
5,858,083 A 1/1999 Stav et al.
5,873,936 A 2/1999 Ogden
5,932,019 A 8/1999 Espinoza et al.

OTHER PUBLICATIONS

WELL–X–TROl by AMTROL Brochure pp. 1–12, beleived to be available more than 1 year prior to filing date of the instant application.

* cited by examiner

*Primary Examiner*—Charles E. Cooley
(74) *Attorney, Agent, or Firm*—Fredrikson & Byron, P.A.

(57) ABSTRACT

Mixing machine for mixing cement components with water to provide a pumpable slurry, and a method for its use. The machine includes a mixing vessel having an inlet for water at an average flow rate and for dry cement components, and a water tank for supplying water at a high flow rate to the mixing vessel and having an internal diaphragm separating the tank into water and air compartments. The water tank includes an inlet for admitting water to the water compartment and a conduit communicating the water compartment with the mixing vessel and capable of accommodating the flow of water at an average flow rate substantially greater than the average flow rate of water into the water compartment. The conduit includes a water meter and valve to monitor and regulate, respectively, the quantity of water supplied to the mixing vessel.

12 Claims, 2 Drawing Sheets

CEMENT MIXING APPARATUS AND METHOD

BACKGROUND OF THE INVENTION

This invention relates to a mixing apparatus for mixing cement, and particularly a gypsum cement composition, with water to form a slurry that is useful in forming floor underlayments and the like.

BACKGROUND OF THE INVENTION

In the manufacturer of poured floors, cementitious aqueous slurries are produced and may be pumped to the site where flooring is to be poured. In the case of Portland cement slurries, the slurry ingredients (commonly cement, sand, aggregate and water) are charged to a vehicle-mounted mixer, and are mixed during the journey to the site where the cement is to be poured. With respect to poured gypsum floors, on the other hand, an appropriate mixing machine is provided at the building site, and sequential batches of a gypsum cement slurry are produced and are pumped through flexible tubing to the location, as in an apartment or office building—where flooring is to be poured. Cement mixing machines of this type are described in Jorgenson, U.S. Pat. Nos 4,075,374 and 4,159,912, the teachings of which are incorporated herein by reference.

Gypsum cement slurries consist of dry cement components (a gypsum cement formulation and sand) and water, and mixing is performed batch-wise, with each batch of fully mixed cement slurry being discharged into a holding container and from there being pumped to the pour location. Bags of gypsum cement composition commonly are trucked to the mixer location, and sand is often available nearby. Water can be obtained from a hydrant source if a hydrant is nearby, but often water is available only from nearby buildings and then only in amounts that can be transferred by a small hose such as a garden hose.

A typical batch of gypsum cement slurry may contain on the order of 30 gallons of water, and each batch is consumed in as little as 1 ½ minutes. Under these circumstances, water at the rate of 30 gallons per 1 ½ minutes (that is, at an average flow rate of 20 gallons per minute) is required, and small diameter (¾ to 1 inch diameter) garden hoses can provide water at this flow rate and commonly at pressures in the range of about 45 to about 80 psi gage pressure. However, in order to provide an appropriate mixing cycle, the dry cement ingredients and water must be charged to the mixing vessel so that mixing can occur for one minute or more to ensure production of a uniform slurry. In turn, the water component must be added to the mixing vessel in a time interval of about 15 seconds. If 30 gallons of water per batch are used, this requires an average flow rate of 120 gallons per minute to the mixing vessel, and garden hose sources of water simply are not capable of providing water at this flow rate.

One attempt to solve this problem involves providing a water tank substantially above the level of the mixer, and continuously discharging water from a garden hose-type source into the water tank. Water can be drawn from the water tank at a much more rapid rate, then, at the beginning of each mixing cycle. A two-fold problem arises. First, the amount of water discharged from the tank into a mixing vessel often is crudely measured by counting the number of seconds that a water valve is permitted to stay open, and it will be understood that substantial variation may occur in the amount of water charged to the mixing vessel. This, in turn, effects how well the slurry can be pumped, the ability of the slurry to self-level when poured upon a prepared surface, and the quality of the resulting floor underlayment. Second, the amount of water added from the garden hose source to the water tank is simply uncontrolled. If the tank is overfilled, water may escape from the water tank to mix with gypsum powder that may have spilled from bags, and gives rise to a messy workplace.

The problem outlined above has existed for 20 or more years, and no good solution appears to have been proposed. It would be desirable to provide a water supply for a mixer in which water could be accumulated in a controlled manner within a tank, and then could be discharged quickly into a mixer following which the process could be repeated. It would also be desirable to control with some accuracy the amount of water so discharged for the purpose of providing uniformity to sequential batches of the gypsum cement slurry.

SUMMARY OF THE INVENTION

I have found the above problems can be largely resolved through the use of a pressure tank having an internal diaphragm to receive water under pressure from a water source such as a garden hose, and to periodically and as needed discharge accurate volumes of water at a high flow rate into the mixing vessel.

In one embodiment, accordingly, my intention provides a mixing machine for mixing cement components with water to provide a pumpable slurry, the machine comprising a mixing vessel having an inlet for water and for dry cement components and a water tank for supplying water at a high flow rate to the mixing vessel. The water tank has an internal diaphragm separating the tank into water and air compartments, an inlet for admitting water to the water tank, a water outlet, and a conduit communicating the water tank with the mixing vessel and capable of accommodating the flow of water at an average flow rate substantially greater than the flow rate of water into the water compartment. The conduit includes a water meter and valve to monitor and regulate, respectively, the quantity of water supplied to the mixing vessel.

In another embodiment, the invention relates to a method of mixing cementitious materials with water to make a pumpable slurry. The method involves providing a mixing vessel having an inlet for water and for dry cement components, and a water tank for supplying water at a high flow rate to the mixing vessel and having an internal diaphragm separating the tank into water and air compartments. The water compartment of the tank is substantially filled with water from the source of water under pressure at a first average flow rate flow rate. A predetermined quantity of the water is discharged from the water compartment to the mixing vessel at a second flow rate substantially greater than the first average flow rate. The water is mixed in the mixing vessel with dry cement components to provide the slurry, and the slurry is discharged from the mixing vessel. The above steps are then repeated to permit batch after batch of the slurry to be rapidly formulated and mixed.

IN THE DRAWINGS

DESCRIPTION OF THE PREFERRED EMBODIMENTS

Figure 1:
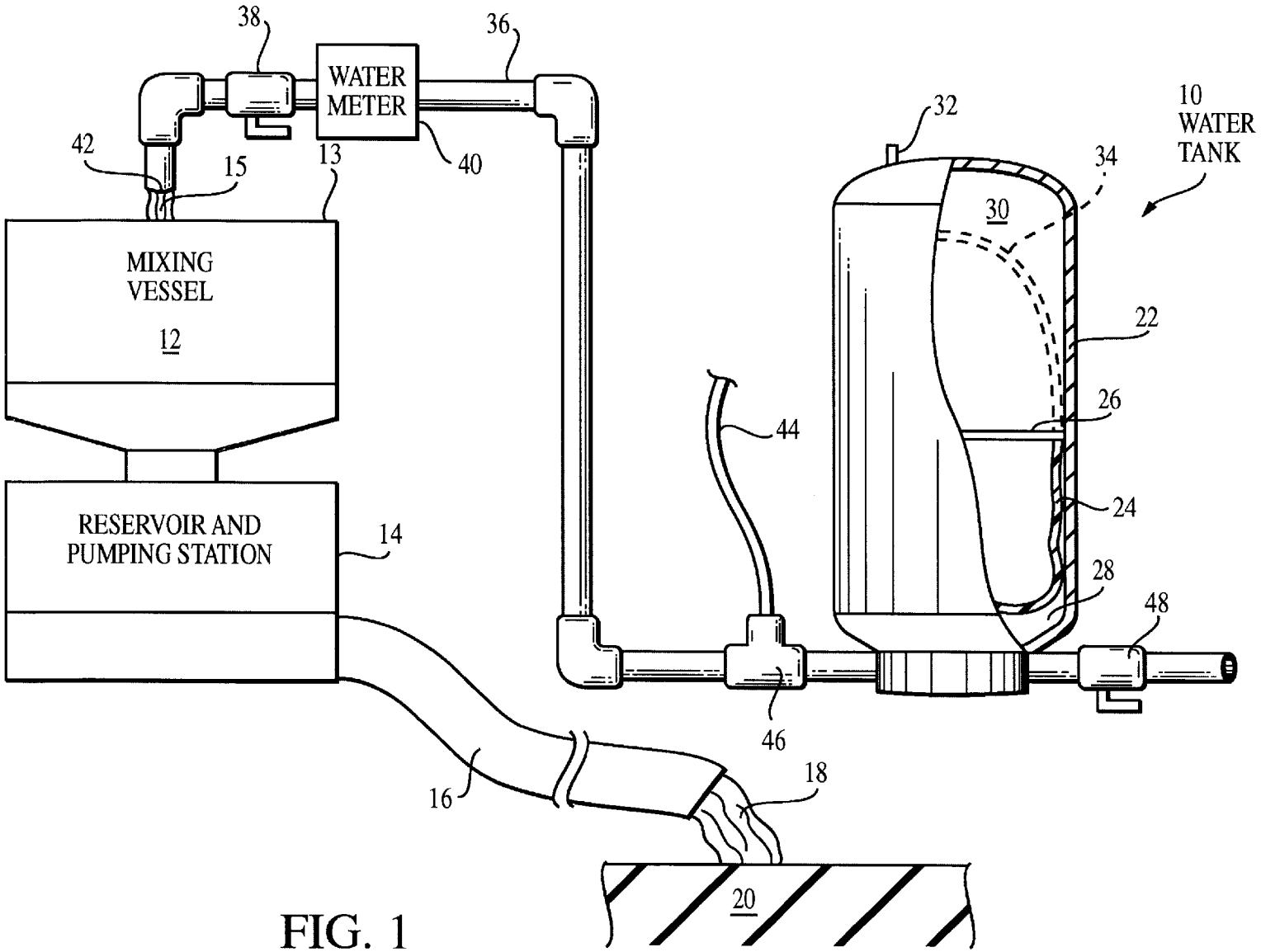
FIG. 1 is schematic view, in partial cross-section, showing a mixing machine of the invention.

FIG. 1 shows the elements of a mixing system of the invention in schematic form, it being understood that these elements may be mounted upon and powered by a truck engine or an auxiliary engine or motor in any convenient manner. Shown at 10 in FIG. 1 is a water tank, which will be described further below. A large mixing vessel is shown at 12, and may be of the twin helix type utilizing a pair of rotating, helical ribbons to rapidly mix the water and dry cement ingredients. The top of the mixing vessel has an inlet 13 through which water 15 and dry cement ingredients (gypsum cement formulations and water, for example) are added to the mixing vessel. Immediately below the mixing vessel 12 is a reservoir and pumping station 14 which receives the well-mixed slurry from the mixing vessel 12. Slurry is pumped from the reservoir 14 utilizing an extruder comprising a helical blade mounted about a rotating shaft to force the slurry from the reservoir and into a flexible delivery tube 16 from whence it exists as slurry 18 upon a prepared surface 20. The mixing vessel 12 and reservoir and pump 14 are well-known in the art, having been used for 15 years or more, and need no further description.

The water pressure tank 10 has a hard outer casing 22 of steel or the like and contains a flexible diaphragm 24. Edges of the diaphragm are mounted to the walls of the tank intermediate the height of the tank, as shown at 26. The diaphragm divides the interior of the tank into a lower water compartment 28 and an upper air compartment 30. A pressure valve 32 is provided through the top of the tank, and enables air to escape from or added to the tank from a source of air under pressure, as desired.

The tank 10 is of the type available from AMTROL Inc., and it will be noted that the diaphragm 24 is sufficiently large so that it substantially bottoms out at the bottom of the tank when all of the water within the tank has been discharged. In its full position, as shown by phantom lines 34, the top of the diaphragm is spaced slightly from the top of the steel tank body. The diaphragm itself is normally cup-shaped with the rim of the cup attached to the walls of the tank, and this permits the diaphragm to flex between its fully empty position and its fully full position without significant stretching of the diaphragm. When in its upper position as shown at 34 in FIG. 1, the diaphragm exerts pressure upon the water within the water compartment, aided by whatever superatmospheric pressure is in the air compartment 30.

A conduit 36 extends from the water tank 10 to above the mixing vessel 12. The conduit is of large diameter tubing, 1 ½" tubing being preferred, so as to accommodate the rapid rush of water through the conduit as water is discharged from the water tank into the mixing vessel. The conduit includes a valve 38 and a water meter 40, preferably an in-line meter, the valve and meter preferably being located near the delivery or downstream end 42 of the conduit, which is where a workman normally is positioned to operate the mixing vessel and pump.

Valve 38 may be manually operated and preferably is valve that can be rotated through 90 degrees from a full-on to a full-off position. The water meter 40 may be any reasonably accurate water meter, and preferably has a digital read-out enabling an operator to determine when a given quantity of water has been added to the mixing vessel so that the valve 38 can be turned off. If desired, the valve 38 can be powered, and may be slaved to the meter 40 so that once a pre-set quantity of water has passed through the meter, the valve 38 is automatically turned off. It is anticipated that the meter and valve may be a single unit, operating in this manner.

The source of water under pressure is illustrated at 44 in FIG. 1 as a flexible tubular hose such as a garden hose. It is connected at one end (not shown) to a source of water under pressure, and at its other end is joined to a "T" 46 in the conduit so as to communicate continuously with the conduit and hence with the interior of the water compartment 28. In the preferred embodiment, water substantially continuously flows through the water supply hose 44 into the conduit.

In use, when it is desired to begin to formulate a batch of cementitious slurry, the water compartment 28 of the water tank will be full or nearly full. The valve 38 will be opened and a given quantity, for example, 30 gallons, of water will be allowed to flow into the mixing vessel 12, the operator observing the water meter 40 and turning the valve 38 off after the proper amount of water has been added. It is desired to begin adding water to the mixing vessel 12 before the dry cement ingredients are added, but once the water flow into the mixing vessel is established, the dry ingredients can be added quickly while mixing continues in the interior of the mixing vessel. When the valve 38 is in its open position, water flows into the conduit 36 both from the water compartment 28 of the water tank and also from the water supply hose 44. As soon as the valve 38 is closed, however, water traveling through the water supply tube 44 enters the water compartment 28 of the water tank, and slowly begins to fill the water tank.

Mixing of the slurry, in the meantime, is occurring within the mixing vessel 12, and when a well mixed slurry has been formed, the slurry is discharged into the reservoir 14 as described above, discharge occurring in a matter of seconds. Following discharge of the slurry, the operator again turns the valve 38 on and water gushes into the mixing vessel as described above to make another batch of slurry. The cycle then continues through subsequent slurry batches until the work has been finished.

With reference again to FIG. 1, it will be noted that following the discharge of water from the water tank, the diaphragm will be in its lower position with little if any water remaining in the water compartment 28. Since the delivery hose 44 continues to deliver water under pressure to the conduit, and since the valve 38 is in its off position, water slowly enters the water compartment 28 under pressure. Water pressure from garden hoses typically varies from about 45 to about 80 psi, and the diaphragm of the water tank is sufficiently flexible as to respond to water in the lower pressure ranges to enable the diaphragm to substantially reach the level shown at 34 in FIG. 1.

The pressure referred to herein is gage pressure rather than absolute pressure. Assuming that the pressure within the air compartment has been pre-set at about 10–12psi when the water tank is empty, it will be understood that as the volume of air in the air compartment is reduced, the pressure of air increases. As the diaphragm 24 reaches its completely full position as shown at 34 in FIG. 1, the diaphragm does not yield easily any further and eventually the pressure of water in the water supply hose 44 (45 to 80 psi) is equalized by the pressure of water in the water compartment and water ceases to flow.

Upon discharge of the water from the water compartment 28, the pressure of water in the water tank decreases rapidly. During a typical 15 second discharge of water, the average flow rate of water may be on the order of 120 gallons per minute, but the flow rate at the beginning of the fifteen second interval is substantially greater than the flow rate at the end of the discharge. What is important, of course, is the total amount of water that is discharged into the mixing vessel 12 within an approximately 15 second period.

Figure 2:
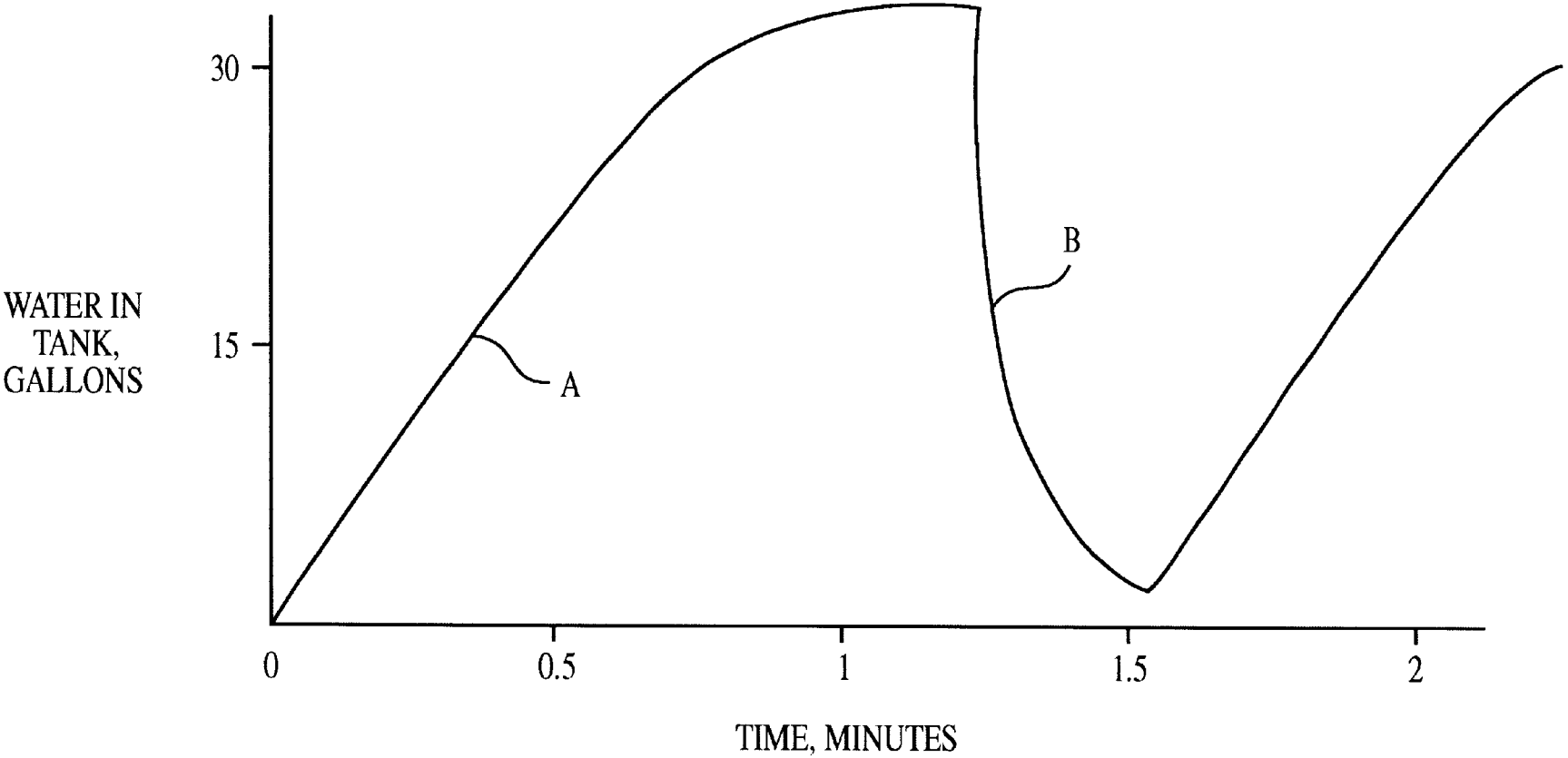
FIG. 2 is a graphic representation of the cycling of water within the water tank employed in the invention.

Referring now to FIG. 2, this graph shows in general the cycling of the volume of water within the water tank as slurry is mixed and discharged on a 90 second cycle. Curve A represents the increase of water volume in the water compartment with time, beginning immediately after a 30 gallon charge of water has been discharged to the mixing chamber. The rate of flow of water into the water compartment decreases as the water compartment fills up and as the air pressure in the air compartment accordingly increases. In the meantime, the previous charge of water and other slurry ingredients are being mixed within the mixing chamber.

Shortly before the 1½ minute mark, the mixed slurry is discharged in a matter of seconds into the reservoir from the mixing chamber, leaving the mixing chamber empty. By this time also, the volume of water in the water compartment has exceeded the 30 gallons needed for mixing the next batch of slurry. At the 1½ minute mark, a measured 30 gallons of water are quickly discharged into the mixing vessel, and the water compartment of the tank is substantially exhausted of water in about 15 seconds. This is shown by Curve B. Note that the flow rate of water decreases as the water level in the tank decreases. Dry ingredients are charged to the mixing chamber, and the cycle continues.

Although adjustments to the pre-pressure of air in the air compartment may be made if needed, I have found that a pre-pressure in the range of 10 to 12 psi in the air compartment is sufficient if the water pressure within the supply hose is within the 45–80 psi range, and no further adjustment is necessary.

Once the cement pouring operating has been completed, water may be drained from the conduit and water tank through an additional drain pipe and valve 48.

If hydrant water is available, it can be connected directly to the conduit, bypassing the water tank 10 and controlled as described above through the use of the water meter 40 and valve 38.

As noted earlier, the present invention is particularly adapted for use when the source of water under pressure is substantially less than that would be required to be added to the mixing vessel during a short period of time such as 15 seconds. In this respect, the flow of water from the water tank to the mixing vessel desirably is 100 gallons per minute or greater, on the average, and preferably is at an average rate of about 120 gallons per minute. The flow rate of water from the water supply hose into the water compartment after each discharge is substantially less than the discharge average flow rate, and an average inlet flow rate of approximately 17 to 20 gallons per minute is ordinarily sufficient, although greater flow rates are of course preferred. Thus, the mixing machine of the invention has utility when the source of water has a flow rate less than that required to operate the mixing equipment at a reasonable speed. For the preparation of gypsum cement underlayment slurries utilizing a mixing vessel that employs approximately 30 gallons per batch, this requires a flow rate yielding 30 gallons of water into the mixing chamber during a 15–20 second time opening. This, in turn, converts to an average flow rate of 90–120 gallons per minute, and hence a source of water that delivers less than about 90 gallons per minute would be substantially less than that which would be needed in the absence of the invention.

While a preferred embodiment of the present invention has been described, it should be understood that various changes, adaptations and modifications may be made thereto without departing from the spirit of the invention and the scope of the appended claims.

What is claimed is:

1. Mixing machine for mixing cement components with water to provide a pumpable slurry, comprising:

a. a mixing vessel having an inlet for water and for dry cement components, and b. a water tank for supplying water at a high flow rate to the mixing vessel and having an internal diaphragm separating the tank into pressurized water and air compartments, a water tank inlet for admitting water from a source of water to the water compartment and communicating the source of water continuously with the interior of said water compartment, the water tank having a conduit communicating the water compartment with said mixing vessel and capable of accommodating the flow of water at an average flow rate substantially greater than the flow rate of water into the water compartment, said conduit having a water meter and valve to monitor and regulate, respectively, the quantity of water supplied to the mixing vessel.

2. The mixing machine of claim 1 including a source of water attached to said water tank inlet and capable of supplying water to the water tank at a flow rate substantially less than the average flow rate of water from the water tank to the mixing vessel.

3. The mixing machine of claim 2 wherein said conduit leads from said water tank through said meter and valve to said mixing vessel, and wherein said water tank inlet communicates with said conduit upstream of said meter and valve.

4. The mixing machine of claim 2 wherein said water tank inlet communicates directly with said water tank.

5. The mixing machine of claim 1 wherein said diaphragm is movable within said water tank upon the admission of water to the tank under a pressure of about 45 psi to about 80 psi between a first position wherein said water compartment is substantially empty and a second position in which said water compartment is substantially full.

6. The mixing machine of claim 5 wherein said diaphragm is sufficiently non-stretchy as to prevent the entry of water under a pressure of less than 80 p.s.i. to the water tank once the water compartment is substantially full.

7. Method of mixing cement with water to make a pumpable slurry, comprising:

a. providing a mixing vessel having an inlet for water and for dry cement components; and a water tank for supplying water at a high flow rate to the mixing vessel and having an internal diaphragm separating the tank into pressurized water and air compartments, b. substantially filling the water compartment of the tank through a water tank inlet with water from a source of water under pressure at an average flow rate, c. while maintaining the source of water in communication with said water compartment, discharging a predetermined quantity of water from the water compartment to the mixing vessel at an average flow rate substantially greater than the average flow rate from said source of water, d. mixing the water in the mixing vessel with the dry cement components to provide said slurry, and discharging the slurry from the mixing vessel, and e. repeating the cycle of steps (a) through (d).

8. The method of claim 7 wherein step (b) occurs during step (d) of the previous cycle.

9. The method of claim 7 or claim 8 including the step of continuously making available to said water compartment water from said source of water under a pressure in the range of 45 to 80 p.s.i.

10. The method of claim 8 wherein said water tank includes a conduit having a water meter and valve and communicating the water tank with said mixing vessel, said water tank inlet communicating with said conduit upstream of said meter and valve, the method including the step of continuously making available to said conduit from said water tank inlet water from said source of water under a pressure in the range of 45 to 80 p.s.i., whereby, after each discharge of water into the mixing vessel, water from said water tank inlet enters and substantially fills the water compartment before the next discharge of water into the mixing vessel.

11. The method of claim 10 wherein, during each discharge, water flows into said conduit from said water compartment and from said water tank inlet.

12. The method of claim 8 wherein said water tank includes a conduit having a water meter and valve and communicating the water tank with said mixing vessel and wherein, in step (c), the valve is opened to discharge water to the mixing vessel and is closed when the meter indicates that the predetermined amount of water has been discharged.

* * * * *